US010232424B2

(12) United States Patent
Koechig

(10) Patent No.: US 10,232,424 B2
(45) Date of Patent: Mar. 19, 2019

(54) DEVICE AND METHOD FOR BENDING PIPES

(71) Applicant: DENGLER TUBETEC GmbH, Witten (DE)

(72) Inventor: Norman Koechig, Iserlohn (DE)

(73) Assignee: DENGLERLANG TUBE TEC GmbH, Witten (DE)

( * ) Notice: Subject to any disclaimer, the term of this patent is extended or adjusted under 35 U.S.C. 154(b) by 106 days.

(21) Appl. No.: 15/422,512

(22) Filed: Feb. 2, 2017

(65) Prior Publication Data

US 2017/0216900 A1 Aug. 3, 2017

(30) Foreign Application Priority Data

Feb. 3, 2016 (DE) ..... 10 2016 101 908

(51) Int. Cl.
*B21D 7/024* (2006.01)
*B21D 7/06* (2006.01)

(52) U.S. Cl.
CPC ..... *B21D 7/06* (2013.01); *B21D 7/024* (2013.01)

(58) Field of Classification Search
CPC ..... B21D 7/02; B21D 7/021; B21D 7/022; B21D 7/024; B21D 7/04
See application file for complete search history.

(56) References Cited

U.S. PATENT DOCUMENTS

| | | | | |
|---|---|---|---|---|
| 4,747,293 A * | 5/1988 | Yagi | B21D 7/022 72/294 |
| 9,468,953 B2 | 10/2016 | Fries et al. | |
| 2004/0065131 A1* | 4/2004 | Schmauder | B21D 7/024 72/149 |

FOREIGN PATENT DOCUMENTS

| | | |
|---|---|---|
| DE | 2208549 B2 | 2/1972 |
| DE | 20301138 U1 | 1/2003 |
| DE | 102011014953 B4 | 5/2014 |
| DE | 102011015570 B4 | 1/2015 |
| EP | 0446819 A2 | 3/1991 |
| EP | 1396295 A1 | 3/2003 |
| EP | 1591174 A1 | 11/2005 |

* cited by examiner

*Primary Examiner* — Pradeep C Battula
(74) *Attorney, Agent, or Firm* — Robert W. Morris; Eckert Seamans Cherin & Mellot, LLC

(57) ABSTRACT

A device for bending tubular workpieces includes a straight workpiece section that extends in a longitudinal direction and is held in a clamping device. A bending tool for bending the workpiece around a bending axis, running transversely to the longitudinal direction, has a radial part and a bending part. The radial part is rotatable about the bending axis. The bending part can be pivoted relative to the radial part for bending the workpiece about the bending axis. For rotatable driving, a radial driveshaft is coupled to the radial part, and a bending driveshaft is coupled to the bending part. To very flexibly create a plurality of different bends and to be able to use variable bend geometries, the radial driveshaft and the bending driveshaft extend in the longitudinal direction. The radial driveshaft and/or the bending driveshaft are designed as a hollow shaft, and one is arranged coaxially around the other.

11 Claims, 5 Drawing Sheets

DEVICE AND METHOD FOR BENDING PIPES

BACKGROUND OF THE INVENTION

The invention relates to a device and method for bending tubular workpieces, in particular pipes.

Various types of bending machines are known for bending e.g., fuel, brake or hydraulic lines.

DE 203 01 138 U1 describes a bending machine with a fixed clamping unit for fixing a pipe to be bent and with a bending unit that can move relative thereto with a bending head to which a bending tool is attached at the end of an extension arm. The bending tool comprises a counter roller and a sliding piece that can be pivoted around the counter roller. The bending tool is positioned by moving the bending head at a bending point so that bending of the pipe is effectuated by pivoting the sliding piece around the counter roller.

In EP 1 591 174, a bending device is described for rod-shaped and tubular workpieces that has a bending head with a bending mandrel and a clamping apparatus for pressing the workpiece to be bent against a shaped groove in the bending mandrel. The bending mandrel can be rotated by means of a rotary drive, and the clamping apparatus can be pivoted concentrically to the rotary axis of the bending mandrel. The bending head is connected to rotary drives that are independent of each other. To transmit the drive from the three rotary drives to the bending mandrel, a conversion gear and the clamping apparatus, three rotary shafts arranged concentrically with each other are provided, each of which is connected to one of the rotary drives.

SUMMARY OF THE INVENTION

It is a principle object of the present invention to provide a device and a method for bending tubular workpieces that can be used very flexibly for a plurality of different bends to produce variable bend geometries.

For a bending device to be particularly flexible in use, a plurality of elements of the bending tool, which participate in bending, are separately drivable. Whereas in principle a single drivable element would be sufficient to cause bending, such that for example one bending part is pivotable relative to a fixed radial part, the flexible utility for different types of bends and types of tubular workpieces is significantly increased by additional drivable elements, such as for bending to the right/left, bending by rolling and drawing, bending workpieces with flexible sections, etc.

The size and arrangement of the parts placed on the bending tool is of decisive importance for the achievable bend geometries. These form the so-called interfering edge, i.e., a restriction of achievable bending without the bent end of the pipeline striking. A small interfering edge is of decisive importance, for example with complicated bend geometries, in particular with larger bending angles.

A central consideration in the development of the device according to the invention and method according to the invention was on the one hand to drive a plurality of elements of the bending tool, whereas on the other hand there should be a small interfering edge.

With the device according to the invention and the method according to the invention, a longitudinal direction corresponds to the direction of the as yet unbent workpiece, i.e., a straight workpiece section, held in a clamping device, of the workpiece to be bent. This longitudinal direction is dictated for the device by the arrangement of the clamping device and the bending workpiece between which the unbent part of the workpiece extends. In the following description, the workpiece will be consistently termed the pipe, wherein the pipe axis runs in the defined longitudinal direction. However, this does not exclude the device from being able to be used to bend other workpieces of a comparable shape such as rods.

According to the invention, a bending tool is provided in order to bend the pipe around a bending axis that runs transversely to the pipe axis. The bending tool comprises at least one radial part and one bending part, wherein the radial part can be rotated about the bending axis, and the bending part can be pivoted about the bending axis relative to the radial part in order to bend the pipe.

A radial driveshaft and a bending driveshaft are provided to rotatably drive the radial part and the bending part. The drive shafts serve to transmit rotation from a drive over a certain distance to the bending tool. The drive can accordingly be arranged at a distance from the bending tool and does not contribute, or only slightly contributes, to the interfering edge. The radial driveshaft is coupled to the radial part, and the bending driveshaft is coupled to the bending part, such that the coupled part is rotated by rotating the respective driveshaft. Accordingly, the two movable elements of the bending tool can be controlled and driven separately by the two driveshafts.

With the device according to the invention and the method according to the invention, a particularly compact arrangement with a small interfering edge is achieved in that the radial driveshaft and the bending driveshaft extend in the longitudinal direction, i.e., parallel to the alignment of the clamped pipe dictated by the clamping device and the bending tool, and the radial driveshaft and/or the bending driveshaft are designed as a hollow shaft, wherein one of the two driveshafts is arranged around to the other of the two driveshafts. Preferably, the radial driveshaft can be designed as a solid shaft, whereas the bending drive shaft is designed as a hollow shaft and is arranged coaxially around the radial driveshaft.

By using driveshafts that are arranged coaxially to each other, of which at least the outer one is designed as a hollow shaft, an extremely compact arrangement is achieved. Because this arrangement also extends in the longitudinal direction and hence parallel to the pipe, a particularly small interfering edge arises such that a plurality of bend geometries, including with large bending angles, is still possible on the bending tool without the bent pipe striking the driveshafts or a housing arranged around them.

In preferred embodiments, the bending tool can comprise further elements that are movable by a drive. For example, a pivotably movable holding part for resting against the pipe can be provided on the tool. Various bends can be supported by a pivotably movable holding part, such as in the case of pipes with flexible sections. To drive the pivotable holding part, a holding part driveshaft can be provided that is coupled to the holding part for rotatable driving, and also extends in the longitudinal direction like the radial driveshaft and the bending driveshaft. It is particularly preferable that the holding part driveshaft can be designed as a hollow shaft and arranged coaxially around the radial driveshaft, and/or the bending driveshaft. A coaxial arrangement of the three driveshafts is particularly preferable, for example with the bending driveshaft as a hollow shaft around the radial driveshaft, and the holding part driveshaft as a hollow shaft around the bending driveshaft. Due to the coaxial arrangement, a particularly compact design with a small interfering edge is achieved, including for bending tools with three elements that are movably driven.

For the pivotably movable holding part, it is preferable for the holding part to be arranged pivotably about a holding part axis that runs parallel to the bending axis, but is arranged at a distance thereto. The holding part can accordingly satisfy a holding function by resting against the pipe at a distance from the bending point.

According to a preferred embodiment of the invention, the bending part is designed so that it has at least one, preferably at least two sections that encompass the radial part. Pivotability of the bending part about the radial part can thus be ensured.

To couple the different drive shafts to the movable elements of the bending tool, preferably one or more corner gears can be provided. These are to be understood as gears that, for example, comprise two or more rotating parts and enable a deflection of the direction of movement so that the rotation of the drive shafts running in the longitudinal direction can be converted into a rotation about the rotary, or respectively pivot axis of the movable parts of the bending tool, wherein these rotary, or respectively pivot axes are preferably aligned transversely, i.e., at least substantially at a right angle, to the longitudinal direction. Accordingly, for example, a corner gear can be provided between the radial driveshaft and the radial part, and/or between the bending driveshaft and the bending part, and/or between the holding part driveshaft and the holding part. Each of the corner gears can comprise at least a pair of bevel gears. Preferably, the drive shafts can have bevel gears on the end.

In preferred embodiments, the bending tool is not stationary but rather suitably positionable relative to the clamping device. Depending on the desired design, this can comprise a positioning in the longitudinal or transverse direction, or a rotation about the longitudinal axis of the pipe as well, or a combination of several or all of these movements.

In particular, it is preferable for the bending tool to be arranged on a bending head that can move in the longitudinal direction relative to the clamping device. The respective bending point can thereby be specifically approached. Whereas it is possible to use a fixed bending tool and move the pipe, or respectively the clamping device instead, a fixed clamping device and a pipe securely clamped therein is preferred in relation to which the bending head can be moved.

It is furthermore preferred for the bending head to be adjustable relative to the clamping device such that the bending tool is rotatable about a rotary axis aligned in the longitudinal direction. With such an arrangement, the bending tool can be rotated about the pipe axis to set the desired bending direction. It is moreover alternatively possible to use a fixed bending tool and instead rotate the pipe, or respectively the clamping device. However in this case as well, a fixed clamping device and fixed pipe are preferred, about the longitudinal axis of which the bending tool can be rotated.

According to a preferred further embodiment of the invention, the bending head can also be adjustable relative to the clamping device so that the position of the bending tool is adjustable transversely to the longitudinal direction. Depending on the direction, such an adjustment can be designated an offset in the horizontal direction, or a lift in the vertical direction. Such an adjustment, in particular between two or more positions that are arranged at a distance in the direction of the bending axis, can for example be used to bring different pipe sections specifically into contact with different sections of the elements of the bending tool. For example, an adjustable lift can be used to bring grooves of different sizes in the radial part, or respectively bending part, into contact with the pipe. An offset of the bending tool relative to the pipe can in particular be used to switch between bending to the right and to the left. To enable this without switching the pipe, a combined lift/offset movement can be used so that the bending tool passes below the pipe previously accommodated on a side between the radial part and bending part, and again accommodates the pipe on the other side.

In a preferred embodiment, the drive shafts, i.e., the radial driveshaft, and/or the bending driveshaft, and/or the holding part driveshaft can be arranged in a tubular housing. Preferably, the tubular housing can extend from a movable bending head in the longitudinal direction toward the bending tool. A particularly compact arrangement with a small interfering edge can thereby be achieved. The tubular housing with the driveshafts arranged therein can be very narrow, for example have a maximum extension in the cross-section that is less than half the length. Preferably, the length of the housing is more than four times the lateral measurement (i.e., of the diameter of a round housing).

For a full understanding of the present invention, reference should now be made to the following detailed description of the preferred embodiments of the invention as illustrated in the accompanying drawings.

DETAILED DESCRIPTION OF THE PREFERRED EMBODIMENTS

Figure 1A:
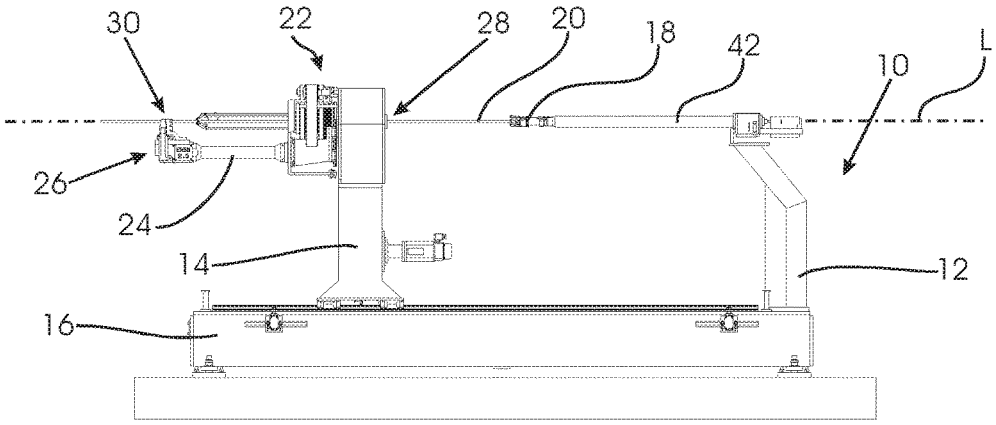
FIGS. 1*a*, 1*b* and 1*c* are side views of a pipe bending machine in different positions.

The preferred embodiments of the present invention will now be described with reference to FIGS. 1-5 of the drawings. Identical elements in the various figures are designated with the same reference numerals.

Figure 1B:
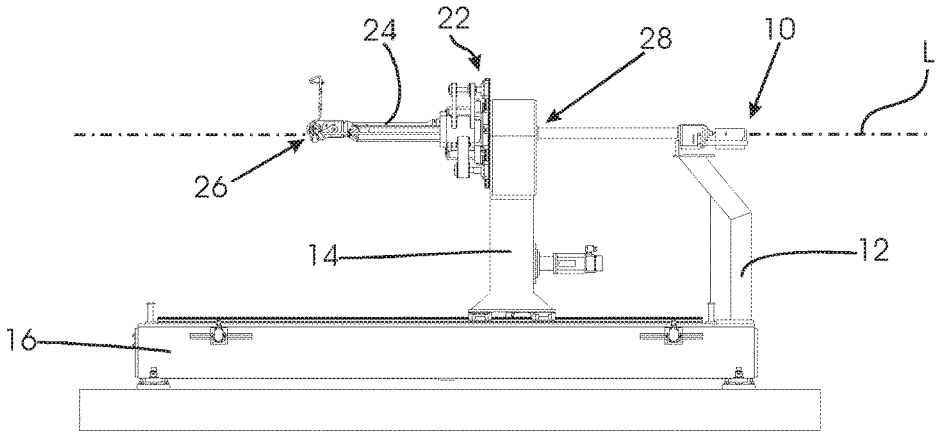
Figure 1C:
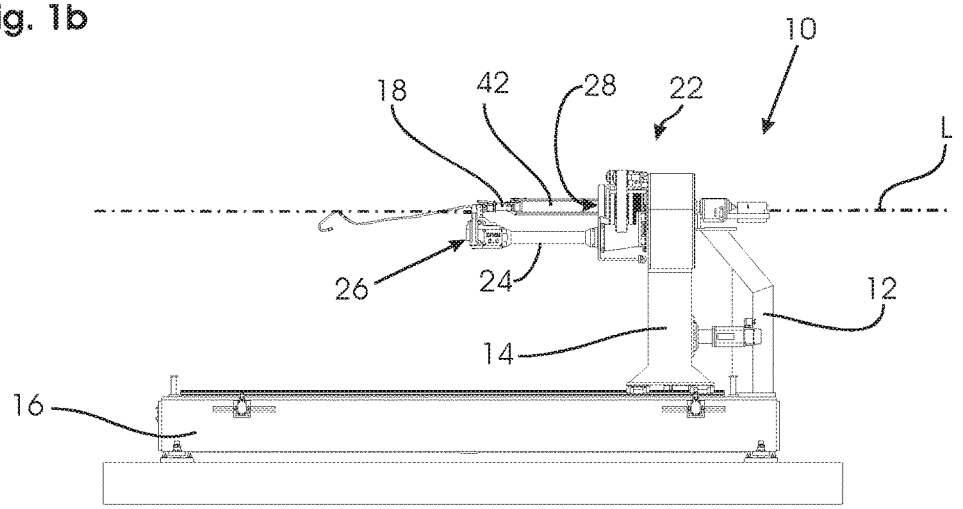
Figure 2:
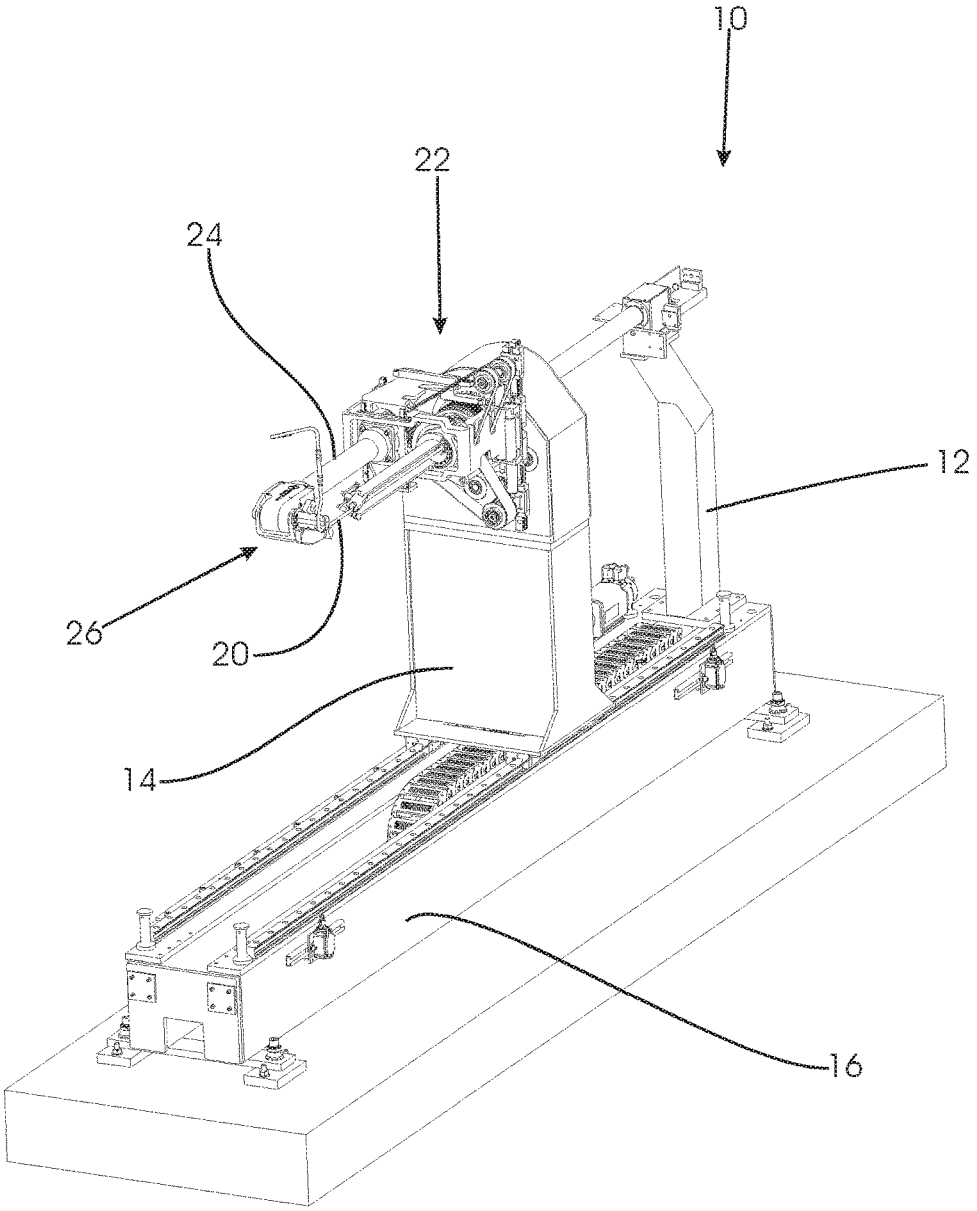
FIG. 2 shows the bending machine from FIG. 1 in a perspective view.

FIGS. 1*a*-1*c* show a pipe bending machine 10 with a fixed clamping unit 12, relative to which a bending tower 14 in a machine bed 16 can be moved in a longitudinal direction L.

The bending tower 14 bears a bending head 22 to which a bending tool 26 is attached by a tool holder 24. The bending head 22 can rotate about the axis. Controllable drives (not shown) are provided for moving the bending tower 14 and rotating the bending head 22.

In FIG. 1*a*, the unbent pipe 20 is securely clamped in a clamping head 18 of the clamping device 12 so that the pipe 20 is aligned in the longitudinal direction L. The clamped pipe end remains consistently stationary during the bending process and is not moved or rotated. The bending head 22 has an opening 28 of an axially running passage through which the pipe 20 is inserted. The bending tool 26 is positioned on the pipe 20.

While the pipe bending machine 10 is operating, the pipe 20 is shaped into a desired bend geometry by the bending tool 26 by applying successive bends. First the bending point at the furthest distance from the clamped end of the pipe 20 is approached, and the bending tool 26 is positioned there. By means of a rotating mechanism (not shown), the bending head 22 can be rotated about the longitudinal axis L of the pipe 20 so that the bending tool 26 can be actuated to create a bend about a bending plane running transversely to the longitudinal axis L.

The elements of the bending tool 26 can be seen more precisely in the depictions in FIGS. 3*a*, 3*b*, 4*a* and 4*b*. On movable, driven elements, the bending tool 26 comprises a radial roller 30 that is rotatable about a bending axis B, a bending roller 32 that is pivotable about the bending axis B, and a counter holder 34 that is pivotable about a pivot axis S.

The radial roller 30 comprises a plurality of bending grooves 36 at a distance from each other in the longitudinal direction of the radial roller 30 that each extend around a part of the circumference of the radial roller 30. The bending roller 32 comprises associated bending grooves 38 at the same spacing which are arranged on the side of the bending roller 32 facing the radial roller 30.

To create a bend in the pipe 20, it is accommodated between the radial roller 30 and the bending roller 32 in one of the radial grooves 36 and one of the bending grooves 38. The different radial grooves 36 and associated bending grooves 38 are provided to accommodate pipes of different outer diameters.

By pivoting the bending roller 32 about the bending axis B, a bend in the pipe 20 is generated in a bending plane perpendicular to the bending axis B while simultaneously rotating the radial roller 30.

The bending roller 32 is arranged to pivot around the radial roller 30 by two holding elements 40 that encompass the bending axis B. Bending by rolling as well as drawing is accordingly possible with the bending tool 26. The bending roller 32 can be pivoted about the radial roller 30 within a pivoting range of at least 180°. Depending on the actuation of the radial roller 30 and bending roller 32 in the bending plane, a bend both to the right and left is possible.

If required by the respective bend which in particular can be the case when bending pipes with flexible sections, the pivotable counter holder 34 can be placed on the side of the pipe 20. As a lever, the counter holder 34 can pivot about the pivot axis S that runs parallel from the bending axis B at a distance. The counter holder 34 can be moved into the suitable pivot position for each bend. Various grooves to be placed against the side of the pipe 20 are provided one above the other in the counter holder 34 as well.

In order to shape the initially unbent pipe 20 into a desired bending geometry, a plurality of bends are made sequentially in the above-describe manner, wherein the bending tool 26 is positioned at the next bending point by moving the bending tower 14 along the longitudinal direction L toward the clamping device 12, then, by rotating the bending head 22 about the pipe axis L, the bending tool 26 is positioned in the desired bending plane, and subsequently the radial roller 30, bending roller 32, and if applicable counter roller 34 are actuated to create the desired bend.

FIGS. 1*a*-FIG. 1*c* sequentially show how the bending tower 14 always gradually approaches the clamping device 12 when creating the sequential bends. In so doing, the clamping head 18 arranged on an extension 42 of the clamping device 12 is guided through the opening 28 and passage in the bending head 22 until the last bend is performed. The bent pipe can then be removed.

Figure 4A:
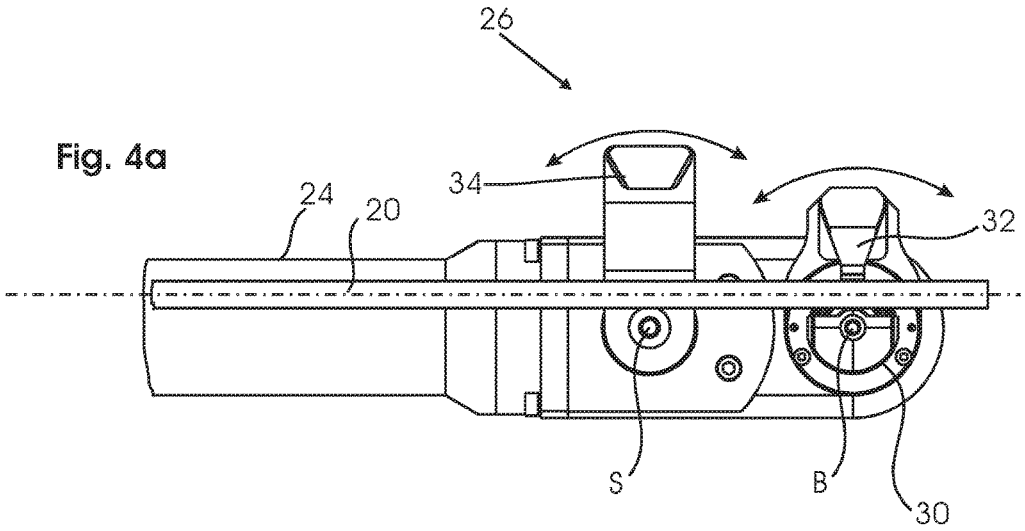
FIGS. 4*a* and 4*b* show a plan view and perspective view of a bending tool on the tool holder from FIGS. 3*a* and 3*b*.
Figure 4B:
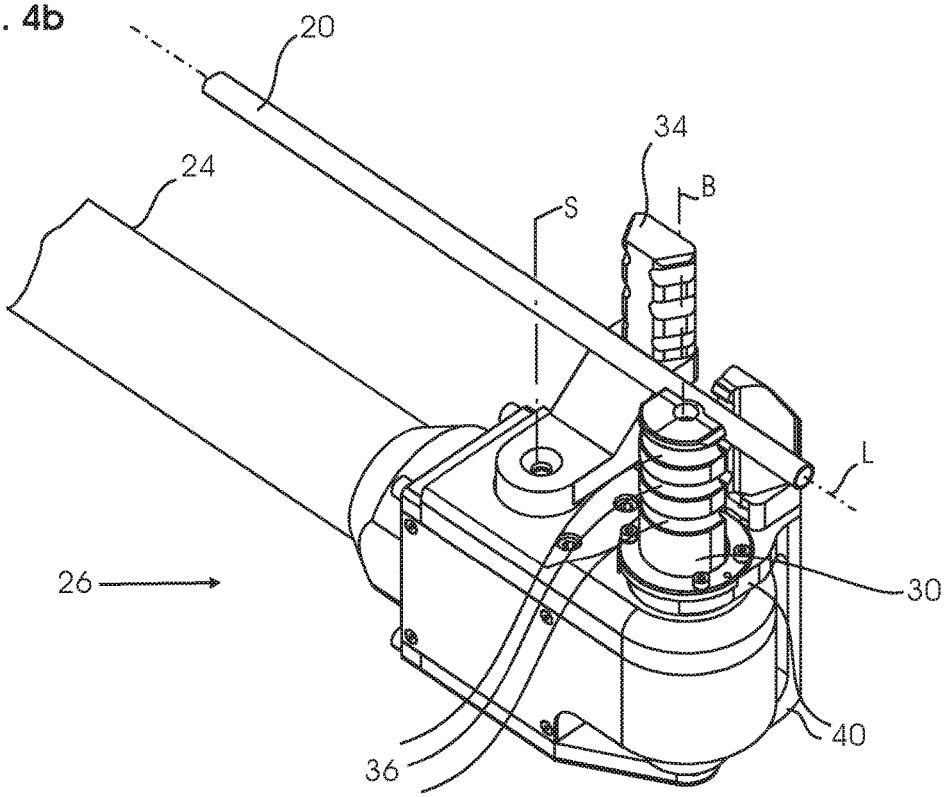

As shown in FIGS. 1*a*-FIG. 1*c* and as can be seen in greater detail in FIGS. 4*a* and 4*b*, only the bending tool 26, from which extends only the elongated, relatively thin tool holder 24, is arranged directly on the pipe 20. Since the tool holder 24 is aligned in the longitudinal direction L and extends toward the clamping device 18, a design is achieved in which, proceeding from the bending point, there is only a very small interfering edge, i.e.; fixed parts of the bending tool 26, or of its attachment (tool holder 24), which the pipe can strike when bending, in particular at large bending angles.

The tubular tool holder 24 serves not only to hold and position the bending tool 26, but also to drive the movable elements 30, 32, 34 of the bending tool 26.

Figure 3A:
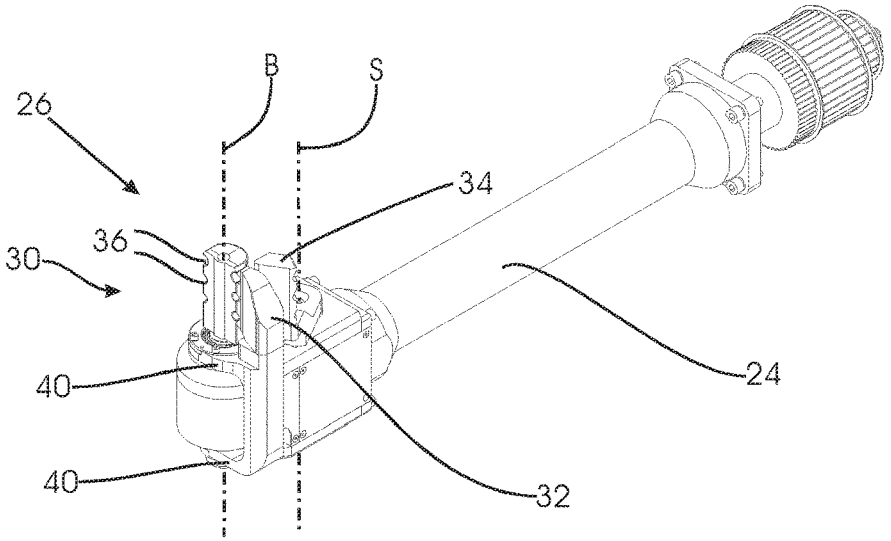
FIGS. 3*a* and 3*b* show perspective views of a tool holder of the bending machine from FIGS. 1*a*, 1*b*, 1*c* and FIG. 2.
Figure 3B:
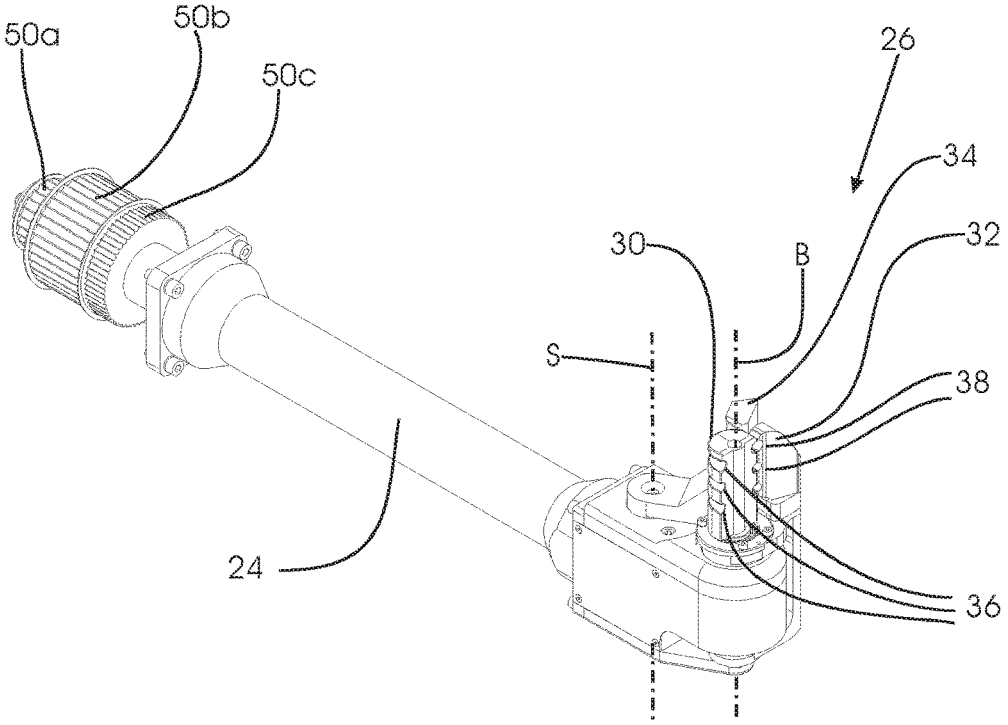
Figure 5:
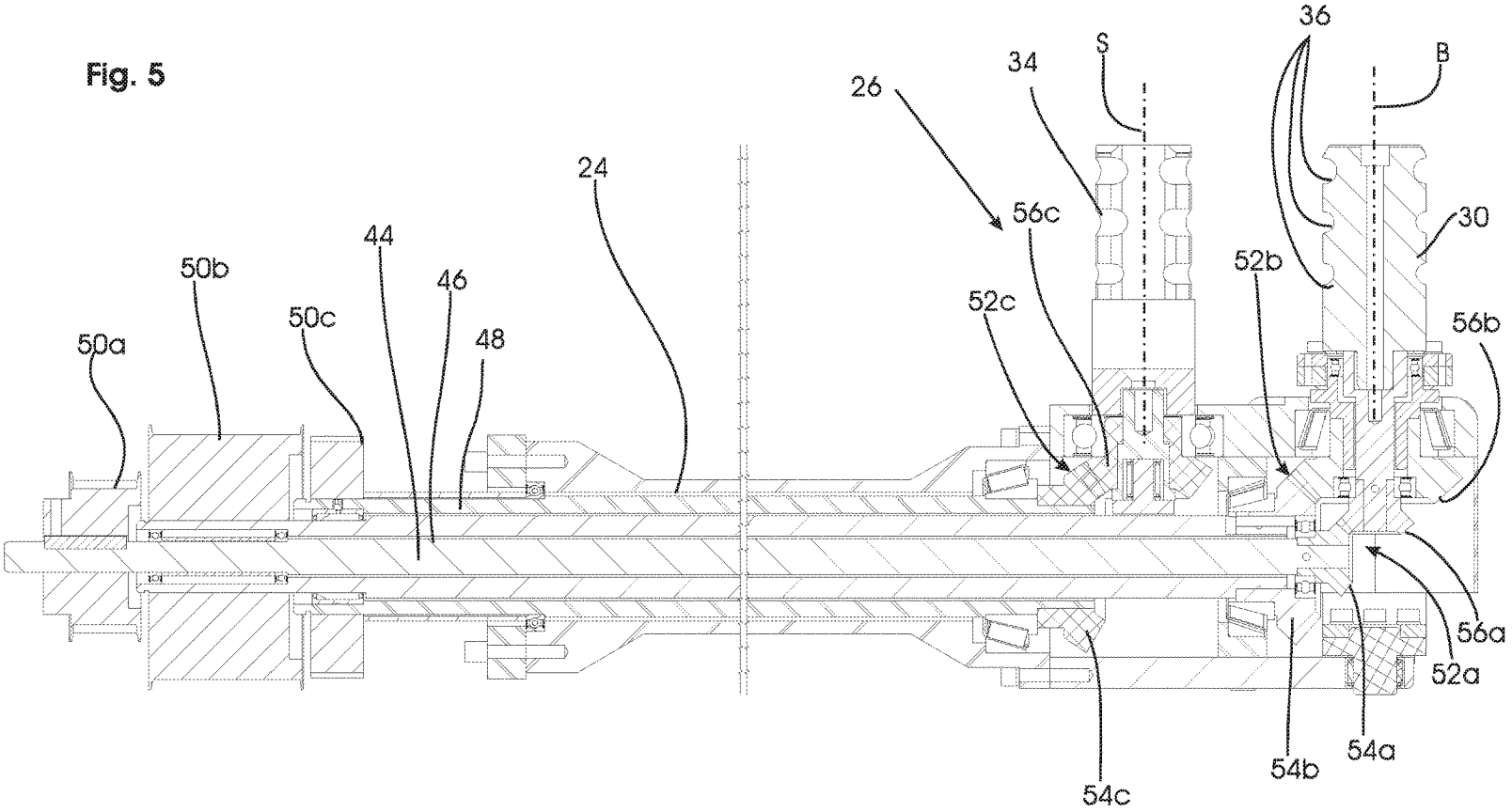
FIG. 5 is a side view of a tool holder from FIGS. 3*a* and 3*b* in a longitudinal section.

As can be seen from the longitudinal section in FIG. 5, the tool holder 24 is a hollow pipe that is fastened at one end to the bending tool 26 and at the other end to the bending head 22 (not shown in FIG. 3*a*, FIG. 3*b* and FIG. 5). FIG. 5 does not show the entire length of the tool holder 24; in fact, the tool holder is about six times as long as it is wide as, for example, can be seen in FIGS. 3*a* and 3*b*.

Three shafts are coaxially arranged within the interior of the tool holder 24. A solid inner shaft serves as a radial driveshaft 44. A hollow shaft arranged around the radial driveshaft 44 serves as a bending driveshaft 46. Arranged, in turn, around the bending driveshaft 46 coaxial thereto is another hollow shaft as a counter holder driveshaft 48.

As can be seen in FIG. 3*a*, FIG. 3*b* and FIG. 5, three drive pinions that are arranged axially next to each other are provided on the end of the tool holder 24. As can be seen in FIG. 5, the inner radial driveshaft 44 is coupled to the rear-most drive pinion 50*a*, the bending driveshaft 46 is coupled to the middle pinion 50*b*, and the outer holding part driveshaft 48 is coupled to the front pinion 50*c*.

Within the bending head 20, drives (not shown) are provided for the pinions 50*a*, 50*b*, 50*c*. They are preferably belt drives.

As shown in FIG. 5, the rotary movement of the three drive shafts 44, 46, 48 is transmitted by corner gears to the radial roller 30, bending roller 32 and counter holder 34.

For this purpose, corner gears are always provided on the end of each of the drive shafts 44, 46, 48 by means of which the rotary movement is deflected by bevel gears at an angle of 90° in the depicted example. A first corner gear 52*a* is formed between a first bevel gear 54*a* formed on the end of the radial driveshaft 44 and a second bevel gear 56*a* coupled to the radial roller 30. A second corner gear 52*b* is formed between a first bevel gear 54*b* formed on the end of the bending driveshaft 46 and a second bevel gear 56*b* coupled to the bending roller 32. The bevel gears 54*a*, 56*a* of the first corner gear 52*a* are designed solid, whereas the bevel gears 54*b*, 56*b* of the second corner gear 52*b* are designed hollow and are arranged coaxial to the bevel gears 54*a*, 56*a* of the first corner gear 52*a*. In this manner, rotary movements of the drive pinion 50*a*, 50*b* are transmitted via the coaxial drive shafts 44, 46 and converted into coaxial rotations of the radial roller 30 and bending roller 32.

A third corner gear 52*c* is formed on the bending tool 26 at a distance from the first and second corner gear 52*a*, 52*b*. For this purpose, the counter holder driveshaft 48 is designed somewhat shorter than the two other driveshafts 44, 46. A first bevel gear 54*c* is arranged on its end and engages with a second bevel gear 56*c* which is arranged around the pivot axis S of the counter holder 34. In this manner, a rotary movement of the drive pinion 54*c* can be transmitted by the counter holder driveshaft 48 and the corner gear 52*c* to the counter holder 34.

Accordingly, the movable elements 30, 32, 34 on the bending tool 26 can be rotatably driven independently and separate from each other in order to execute desired rotary, or respectively pivoting movements to create desired bends. The achievable movements are not thereby restricted, so that bends to the right/left are also enabled as well as rolling/draw bending as desired.

Thereby the tool holder 24 makes it possible for the bending tool 26 to be suitably positioned by the bending head 22, wherein at the same time a drive of the elements 30, 32, 34 of the bending tool 26 is achieved in an extremely compact arrangement with a small interfering edge.

There has thus been shown and described a novel device and method for bending pipes which fulfills all the objects and advantages sought therefor. Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention, which is to be limited only by the claims which follow.

The invention claimed is:

1. A method for bending tubular workpieces, comprising the steps of:

holding a tubular workpiece in a clamping device with a straight workpiece section that extends in a longitudinal direction (L) in a clamping device, and bending the workpiece in a bending tool by pivoting a bending part relative to a radial part about a bending axis that runs transversely to the longitudinal direction (L), wherein the radial part is rotatably driven by a radial driveshaft, and the bending part is rotatably driven by a bending driveshaft that extends in the longitudinal direction (L), and wherein at least one of the radial driveshaft and the bending driveshaft is designed as a hollow shaft, and one of the driveshafts is arranged coaxially around the other.

2. A device for bending a tubular workpiece comprising in combination:

a clamping device for a straight workpiece section, running in a longitudinal direction (L) of a tubular workpiece, a bending tool for bending the workpiece around a bending axis (B) that runs transversely to the longitudinal direction (L) with at least one radial part and a bending part, wherein the radial part is rotatable about the bending axis (B), and the bending part is pivotable relative to the radial part for bending the workpiece about the bending axis (B), a radial driveshaft for rotatable driving, coupled to the radial part, and a bending driveshaft for rotatable driving, coupled to the bending part, wherein the radial driveshaft and the bending driveshaft extend in the longitudinal direction (L), and wherein at least one of the radial driveshaft and the bending driveshaft is designed as a hollow shaft, and one driveshaft is arranged coaxially around the other.

3. The device according to claim 2, wherein a pivotably movable holding part for resting against the workpiece is provided on the bending tool, and wherein a holding part driveshaft for rotatable driving is coupled to the holding part and extends in the longitudinal direction (L).

4. The device according to claim 3, wherein the holding part driveshaft is designed as a hollow shaft and is arranged coaxially around at least one of the radial driveshaft and the bending driveshaft.

5. The device according to claim 3, wherein the holding part can be pivoted around a holding part (S) axis that is arranged parallel to and at a distance from the bending axis (B).

6. The device according to claim 2, wherein the bending part has at least one section that encompasses the radial part.

7. The device according to claim 2, wherein a corner gear is provided between at least one of the radial driveshaft and the radial part, the bending driveshaft and the bending part, and between the holding part driveshaft and the holding part that comprises at least one pair of bevel gears.

8. The device according to claim 2, wherein the bending tool is arranged on a bending head that is moveable in the longitudinal direction (L) relative to the clamping device.

9. The device according to claim 8, wherein the bending head is adjustable relative to the clamping device such that the bending tool is rotatable about an axis aligned in the longitudinal direction.

10. The device according to claim 8, wherein the bending head is adjustable relative to the clamping device such that the bending tool is movable transversely to the longitudinal direction.

11. The device according to claim 8, wherein at least one of the radial driveshaft, and the bending driveshaft, and the holding part driveshaft are arranged in a tubular housing that extends from the bending head in the longitudinal direction (L).

* * * * *